United States Patent [19]

Wagner

[11] 4,123,573

[45] Oct. 31, 1978

[54] METHOD FOR IMPARTING FLAME RETARDANT PROPERTY TO CELLULOSIC CONTAINING MATERIAL

[75] Inventor: George M. Wagner, Lewiston, N.Y.

[73] Assignee: Hooker Chemicals & Plastics Corp., Niagara Falls, N.Y.

[21] Appl. No.: 808,015

[22] Filed: Jun. 20, 1977

Related U.S. Application Data

[63] Continuation of Ser. No. 715,763, Aug. 19, 1976, abandoned, which is a continuation of Ser. No. 537,525, Dec. 30, 1974, abandoned.

[51] Int. Cl.[2] ..... D06M 13/44

[52] U.S. Cl. ..... 427/324; 8/116 P; 427/302; 427/303; 427/390 D; 427/394; 428/921

[58] Field of Search ..... 8/116 P; 427/302, 303, 427/324, 390 D, 394; 428/921

[56] References Cited

U.S. PATENT DOCUMENTS 3,784,356 1/1974 Wagner ..... 8/196

FOREIGN PATENT DOCUMENTS 304,900 1/1929 United Kingdom ..... 427/324

OTHER PUBLICATIONS

Guthrie; John D. et al., *Application of the THPC Flame-Retardant Process to Cotton Fabrics,* 1954.

*Primary Examiner*—Michael R. Lusignan
*Attorney, Agent, or Firm*—Peter F. Casella; William J. Crossetta, Jr.

[57] ABSTRACT

A method of imparting flame retardant character to cellulosic containing material by applying an effective fire retarding imparting amount of a phosphorous composition to the material and curing the phosphorous composition, the improvement comprising pretreating the material with an aqueous caustic solution prior to applying the phosphorous composition, wherein the material contains at least 20% polyester.

7 Claims, No Drawings

METHOD FOR IMPARTING FLAME RETARDANT PROPERTY TO CELLULOSIC CONTAINING MATERIAL

This a continuation of application Ser. No. 715,763, filed Aug. 19, 1976, now abandoned; which in turn is a continuation of Ser. No. 537,525, filed Dec. 30, 1974, now abandoned.

BACKGROUND OF THE INVENTION

Numerous patents teach the utilization of various flame retardant compounds and compositions for imparting flame retardant character to cellulosic containing materials. Examples of these are U.S. Pat. Nos. 3,276,897; 2,983,623; 2,433,370; 3,552,909; 3,556,991; 3,674,539.

SUMMARY OF THE INVENTION

The present invention is concerned with a method for imparting flame retardant characteristic to cellulosic containing materials. In particular, the method is concerned with pretreating the cellulosic containing material, prior to contacting with a flame retardant phosphorus containing composition. The pretreatment step comprises scouring the fabric with a caustic solution.

DESCRIPTION OF PREFERRED EMBODIMENTS

It is highly desirable that cellulosic containing materials such as fabric used in children's sleepwear and other clothes, be made durably flame retardant as determined by stringent government standards (Department of Commerce Standard FF-3-71) which require that the treated fabrics withstand at least 50 home washings.

In order to impart a durable flame retardant property to cellulosic containing materials, the process of the present invention is followed. In addition, it has been found that consistent results are obtained when following the process of the present invention.

The method of the present invention can best be described as prior to the application of a phosphorus containing composition or other flame retardant compositions to a cellulosic containing material, the material is pretreated with a caustic solution and then the phosphorous fire retardant composition is applied to the pretreated substrate.

It should be appreciated that the cellulosic containing material that is treated with the caustic may remain in the wet state prior to the application with the phosphorous containing compositions.

The normal sequence of treatment of the fabric is as follows:

1. Desize;
2. Wash;
3. Bleach;
4. Wash;
5. Caustic pretreatment step;
6. Steam (optional but employed if there is a wash step after caustic pretreatment and prior to application of phosphorus composition);
7. Application of phosphorous containing flame retardant composition;
8. Wash;
9. Dry;
10. Cure with ammonia;
11. Wash;
12. Dry.

It is to be appreciated that other pretreatment steps prior to the caustic treatment step of the present invention may be added as desired depending upon the commercial technique employed by the textile mill. It has been found highly desirable that after the application of the caustic, that the product be steamed in order to open the fibers and make them readily susceptible to accepting the fire retardant composition.

The caustic that is applied in the pretreatment step may range from 1 to about 10% by weight, preferably about 3–7%. It should also be appreciated that the amount of caustic that is applied in the pretreatment step may be used in conjunction with the caustic that is present in the subsequent step wherein the phosphorus composition is applied to the treated fabric. The phosphorus containing fire retardant compositions that may be applied to the caustic treated fabric are those that contain an aqueous solution of tetrakis (alpha hydroxyorgano) phosphonium hydroxide of the formula $[R-CH(OH)]_4P-OH$.

The phosphonium hydroxide composition can be formulated from an aqueous solution of tetrakis (alpha-hydroxy organo) phosphonium halide by adjusting the pH to about 7 to about 9, with caustic.

The tetrakis (alpha-hydroxyorgano) phosphonium halide compound of the subject composition may be further defined as a compound having the formula:

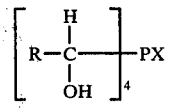

wherein R is selected from the group consisting of hydrogen, lower alkyls having between about 1 and about 6 carbon atoms, halogenated lower alkyls having between about 1 and about 6 carbon atoms, lower alkenyls having between about 1 and about 6 carbon atoms, halogenated lower alkenyls having between about 1 and about 6 carbon atoms, aryls having between about 6 and about 10 carbon atoms, halogenated aryls having between about 6 and about 10 carbon atoms, cycloalkyls, having between about 3 and about 6 carbon atoms, halogenated cycloalkyls having between about 3 and about 6 carbon atoms and X is a halogen, such as chlorine, bromine, fluorine or iodine. Typical examples of suitable tetrakis (alpha-hydroxyorgano) phosphonium halide compounds are tetrakis (hydroxymethyl) phosphonium chloride, tetrakis (hydroxymethyl) phosphonium bromide, tetrakis (hydroxyethyl) phosphonium chloride, tetrakis (alpha-hydroxypropyl) phosphonium chloride, tetrakis (alpha-hydroxyallyl) phosphonium chloride, tetrakis (alpha-hydroxybenzyl) phosphonium chloride, tetrakis (alpha-hydroxymethyl-cyclohexyl) phosphonium chloride, tetrakis (a-hydroxypropyl) phosphonium chloride, tetrakis (alpha-hydroxybutyl) phosphonium chloride and mixture thereof. The phosphonium compounds may be used in monomer form or in a partially polymerized for, so long as they are still water soluble. For example, tetrakis (hydroxymethyl) phosphonium chloride, which is the preferred phosphonium compound, may be heated to effect partial polymerization before dissolving it in the solution.

In accordance with a preferred mode of carrying out the improved process of this invention, after a cellulose containing material has been pre-treated with caustic (NaOH preferably), and steamed in a "J" shaped heater, an aqueous solution of tetrakis (hydroxymethyl) phosphonium hydroxide containing from about 10 to about 40 percent by weight of tetrakis (hydroxymethyl) phosphonium hydroxide and having a pH of from about 7 to about 9 is prepared and used to impregnate the treated material, and, after drying the impregnated material to about 0 to about 8 percent moisture, exposing said material for at least about 5 to less than about 45 seconds and preferably for about 15 to about 30 seconds to an atmosphere containing at least about 50 percent by volume of ammonia, and preferably from about 70 to about 90 percent of gaseous ammonia. The thus treated material containing an insoluble polymer of the phosphonium compound in and on the material is washed and dried.

The treatment of the dried impregnated materials with ammonia, i.e., the curing step, is carried out in an enclosed chamber wherein the impregnated material is exposed to a gaseous atmosphere containing a high concentration, i.e., above about 50 percent by volume, of ammonia. The material is preferably passed into and out of the chamber, in a continuous manner and at a relatively high speed, so that the material is exposed to the ammonia atmosphere for at least 5 seconds and preferably from about 15 to about 30 seconds.

The cellulose materials which can be treated to impart flame retardant properties thereto in accordance with this invention include cotton, rayon, paper, jute, ramie, wood and mixtures thereof, as well as blends of cellulosics, such as cotton or rayon with synthetic materials, such as nylon, polyesters, acrylics, and with proteinaceous fibers, such as wool and the like. The process of this invention is particularly effective when applied to the treatment of cellulosic-containing materials such as cotton and rayon.

The solution used to impregnate the cellulose-containing material comprises tris (hydroxymethyl) phosphine and tetrakis (hydroxymethyl) phosphonium hydroxide as an equilibrium mixture. Such a solution is well known in this art and can be prepared by several known methods. Preferably these solutions are prepared by reacting a aqueous solution of tetrakis (hydroxymethyl) phosphonium chloride with an approximately equimolar quantity of an organic or inorganic base, preferably sodium hydroxide. The pH of the final solution is adjusted to from 7 to 9 and preferably to from 7.5 to 8.1. For the purpose of this invention, the active component of the aqueous solution is considered to be tetrakis (hydroxymethyl) phosphonium hydroxide. Hereinafter, the active component will be expressed in terms of this component, although it is probable that there is present a mixture of tris(hydroxymethyl) phosphine and tetrakis-(hydroxymethyl) phosphonium hydroxide.

The aqueous treating solution may be applied to the cellulosic material in any convenient manner. For example, the solution may be applied by padding, dipping, spraying, and the like. After impregnation, the excess solution is preferably removed from the material by passing the material through squeeze rolls, centrifuging, wringing, or other methods. Although a wet-pick up of from about 50 to about 200 percent may suitably be used, preferably the material contains about an equal weight, i.e., about 100 percent pick-up, of the treating solution.

The impregnated material is then dried to a residual moisture content of about 0 to about 8 percent and preferably from about 0 to about 3 percent. The drying is carried out in air or in drying oven at temperatures which may vary from ambient to about 100° C. Excessive drying temperatures and times are to be avoided. The drying time may vary according to the drying temperature and also the weight and fibrous nature of the material, as will be obvious to those skilled in this art. The moisture content of the material may be measured by a conventional moisture meter.

The dried impregnated material is exposed to gaseous ammonia in an enclosed chamber wherein the resin monomer reacts rapidly and completely to form an insoluble polymer within the material. The gaseous atmosphere which comprises at least about 50 percent of gaseous ammonia, and preferably from about 70 to about 90 percent or more of gaseous ammonia provides an effective, efficient and surprisingly rapid reactant for the resin curing step. It has been found that the curing step is completed, under these conditions, in less than about 45 seconds and generally less than about 30 seconds, and as low as 5 seconds, whereas in prior art procedures from about 1 to about 6 minutes were required from substantially complete polymerization and curing of the impregnated composition.

Following the polymerization and/or curing operation, the treated material is preferably oxidized, scoured or washed to remove unpolymerized materials and the like. Where the present invention is carried out on yard goods using mill apparatus, this scouring operation may be effected using any of the conventional scouring processes such as rope scouring, open width scouring, jig scouring and the like. The scouring may be conveniently carried out using, e.g., an aqueous soap solution containing small amounts of sodium carbonate, perborate or peroxide, and synthetic detergents. Preferably this scouring is carried out immediately after the curing step. The scouring step may be followed by a conventional drying operation and thereafter the dried treated material may be subjected to any normal finishing operation such as sanforizing, calendering, and the like.

While it has been indicated that the phosphonium halide is the preferred composition, it is to be appreciated that other salts may be employed such as inorganic salts as sulfuric acid salts and the like or organic acid salts, such as acetic, formic, oxalic and the like.

When the cellulosic fabric is employed in the present invention, it should be a blend of cellulosic and polyester wherein the amount of polyester ranges from about 20% to about 65% by weight. More preferably the process of the present invention is employed with the sequential application of phosphorous compositions, i.e., after the treatment of the fabric with caustic, the fabric is then subjected to two applications of phosphorous flame retarding compositions; the sequential process is further described in applicant's Case 3396/3447 filed concurrently herewith, all of which is hereby incorporated by reference.

While having described the invention above in general, applicant now describes the invention in other embodiments below. All percentages are percentages by weight and all temperatures are in degrees Fahrenheit.

EXAMPLE 1

When 35 polyester/65 cotton flannel (2.93 yd/lb) is given a normal fabric preparation by a caustic steam and bleach cycle and then treated with 32% of tetrakis (hydroxymethyl) phosphonium chloride in aqueous caustic which has a pH about 7.9 and cured in an ammonia atmosphere, 5 of 5 specimens burn after 50 home washes. If the same untreated fabric is subjected to a hot water rinse or a soap-soda wash before treatment with the same phosphorous composition, the samples still burn after 50 home washes. However, when this normal preparation is followed by saturation of 3% caustic and 30 minutes of steaming and then treated with 32% of the same phosphorous composition and cured in the same manner, the durability is excellent, with an average char. length of 1.6 inches after 50 home washes.

EXAMPLE 2

When normal mill prepared 35 polyester/65 cotton flannel is treated with 28% tetrakis (hydroxymethyl) phosphonium chloride in aqueous caustic which has a pH about 7.9 and cured in an ammonia atmosphere, the sample burns after 50 home washes. When this same untreated fabric is saturated with 3% caustic, and steamed for 20 minutes before treatment in the same manner stated above, the average char. length after 50 home washes is 3.6 inches. However, when the fabric is steamed for only 10 minutes after the caustic saturation, 3 of 5 specimens burn. And when no steam is applied, the durability is also unacceptable with 2 out of 5 specimens burning.

EXAMPLE 3

When a 35 polyester/65 cotton flannel is prepared with a caustic steaming and bleach cycles by the normal mill procedure, and then treated with 30% of tetrakis (hydroxymethyl) phosphonium chloride in aqueous caustic which has a pH of about 7.9 and cured in an ammonia atmosphere, the sample burns after 50 home washes. However, if the caustic steaming step during the mill preparation is significantly lengthened and the fabric is then treated in the same manner stated above, no specimens burn and the average char. length is 4.7 inches after 50 home washes. Furthermore, if this improved fabric is subjected to an additional 3% caustic saturation and 20 minute steaming before treatment with the same phosphorous process, the durability is further improved to a 2.7 inch average char. length after 50 home washes.

EXAMPLE 4

5,000 Yards of soft-filled sheeting, 35% polyester/65% cotton, were desized, bleached and napped. Half of this yardage was left in this state ("A"), the other half ("B") was impregnated with 3% caustic and steamed for 15 minutes by passing the fabric continuously through a small "J" box. After this treatment, the fabric was washed in rope form to remove all traces of caustic and dried. Both fabrics were then impregnated with a 30% THPOH solution neutralized to pH 7.2, dried continuously for 30 seconds at 250° F. in a conventional tenter frame, and then cured for 10 seconds in a commercial ammoniator containing 90% ammonia gas. The fabrics were oxidized with 6% hydrogen peroxide rinsed and dried. Samples taken at each end of the 2,500 yard segments and at 500 yard intervals, were washed and tested according to Federal Standard FF-3-71. The results are shown in Table I. The fabric having no pretreatment has long chars. and many complete failures. The pretreated fabric has no failures and all chars. are consistently short.

TABLE I

| EFFECT OF CAUSTIC PRETREATMENT | | | | | | |
|---|---|---|---|---|---|---|
| Fabric A (No Pretreatment) | | | | | | |
| | 1 (End) | 2 | 3 | 4 | 5 | 6 (End) |
| Fill | 2.8 | 3.1 | 4.2 | 1.9 | 2.9 | Burn |
| Fill | 4.1 | 1.9 | 4.0 | 2.2 | 2.7 | 2.8 |
| Warp | Burn | 6.2 | 3.1 | 4.1 | 4.0 | 4.0 |
| Warp | 4.2 | Burn | 2.9 | 6.0 | 2.9 | 5.1 |
| Warp | 1.8 | 2.1 | 4.8 | Burn | 7.8 | Burn |
| Fabric B (Pretreated) | | | | | | |
| | 1 (End) | 2 | 3 | 4 | 5 | 6 (End) |
| Fill | 2.2 | 2.0 | 1.8 | 2.2 | 2.6 | 1.9 |
| Fill | 2.4 | 2.1 | 2.5 | 2.7 | 2.9 | 2.2 |
| Warp | 1.8 | 2.5 | 3.0 | 2.5 | 3.0 | 2.4 |
| Warp | 2.4 | 2.0 | 2.5 | 1.9 | 2.9 | 2.8 |
| Warp | 1.8 | 1.9 | 2.3 | 2.0 | 2.1 | 3.0 |

Where steaming of the fabric is employed, the steaming should occur for a period of time for at least 15 minutes, preferably about 20 to about 60 minutes.

EXAMPLE 5

A 50/50 polyester cotton blend fabric was soaked in 7.5% NaOH solution for 30 minutes. The fabric was then squeezed between padder rolls at a pressure of 60 psig., padded through a solution of "THPOH" squeezed at 60 psig., dried and ammoniated. The "THPOH" pad solution formulation was tetrakis (hydroxymethyl) phosphonium chloride (80%) 69.8 parts, NaOH (50%) 4.8 parts, X-100 wetting agent 0.1 parts, and 25.3 parts $H_2O$. The solution was prepared by dropping the NaOH into ice cold tetrakis (hydroxymethyl) phosphonium chloride plus $H_2O$. After this addition, the wetting agent was added. The drying was done at 200° F. for 1 minute. After cooling to room temperature, the partially dried swatch was subjected to a gaseous $NH_3$ atmosphere for 3 minutes followed by oxidation by immensing the ammoniated swatch in 10% $H_2O_2$ for 5 minutes. The swatch was then scoured in soda ash and a phosphate detergent and dried. The finished swatch showed a weight add-on of 21.3%, a 4.1% phosphorous content and a 2.3% nitrogen content. After 50 home washes, the swatch had flame retardance as shown by the vertical flame test method specified by DOC FF-3-71; a 6 inch char. length.

EXAMPLE 6

A 50/50 polyester/cotton blend fabric was treated by the procedures shown in Example 5 except instead of a 30 minute soak in 7.5% NaOH the swatch was dipped in the 7.5% NaOH solution and squeezed immediately between padder rolls at 60 psig. The wet swatch was then subjected to the drying and ammoniation procedures noted above. A swatch dried at 200° F. for 30 seconds and finished as above showed a 17.5% weight add-on, a 3.9% phosphorous content, and a 5¾ inch vertical char. length after 50 home washes. A swatch dried at 200° F. for 3 minutes and finished as above showed a 21.3% weight add-on, a 4.6% phosphorous content and a 4¾ inch vertical char. length after 50 home washes.

EXAMPLE 7

The 50/50 polyester/cotton blend fabric used in the two previous examples was treated with a similar tetrakis (hydroxymethyl) phosphonium chloride pad solution without the NaOH pretreatment. The treated fabric was then subjected to the same processing steps as described in Example 1. A swatch dried for 30 seconds at 200° F. showed a 23.0% weight add-on, a 5.4% phosphorous content and no flame retardance after 25 home washes. A swatch dried for 1 minute at 200° F. showed a 20.2% weight add-on, a 4.9% phosphorous level and no flame retardance after 25 home washes. A swatch dried for 1½ minutes at 200° F. showed a 16.9% weight add-on, a 4.3% phosphorous content and no flame retardance after 25 home washes.

While the aforementioned examples indicate that sodium hydroxide may be used as the pretreatment caustic containing composition, other caustic materials may be employed such as alkali metal hydroxides such as potassium hydroxide and the like.

For additional descriptions for application of phosphorous compositions, see U.S. Ser. No. 244,574, filed Apr. 17, 1972, now U.S. Pat. No. 3,846,155 and U.S. Ser. No. 385,782, filed Aug. 6, 1973, now U.S. Pat. No. 3,860,439 herewith applicant's Case 3396/3447 filed concurrently, all of which are hereby incorporated by reference.

I claim:

1. A method of imparting flame retardant character to cellulosic containing material which includes at least 20 percent by weight of a polyester by applying an effective fire retarding imparting amount of a phosphorus composition to the material and curing the phosphorus composition, the improvement which comprises pretreating the cellulose containing material with from about 1 to about 10 percent by weight of an aqueous caustic solution prior to applying the phosphorus composition.

2. The method of claim 1 wherein the phosphorus composition is tetrakis (hydroxy methyl) phosphonium hydroxide.

3. The method of claim 2 wherein the phosphorous compound is present in an amount from 10 to 40% by weight.

4. The method of claim 1 wherein said cellulosic containing material is steamed after said caustic pretreatment step.

5. The method of claim 4 wherein said steaming step is carried out for a period of from about 15 to about 60 minutes.

6. The method of claim 1 wherein said pretreatment step comprises scouring with said caustic solution.

7. The method of claim 6 wherein said caustic is sodium hydroxide.

* * * * *